United States Patent [19]

Hoerr et al.

[11] Patent Number: 4,913,052

[45] Date of Patent: Apr. 3, 1990

[54] PROPELLANT CHARGE IGNITER WITH A SEPARATING CHARGE, WHICH IS INITIATED BY A PROPELLANT CHARGE POWDER

[75] Inventors: Alfred Hoerr, Zirndorf; Horst Penner, Fuerth; Uwe Brede, Fuerth; Heinz Riess, Fuerth, all of Fed. Rep. of Germany

[73] Assignee: Dynamit Nobel Aktiengesellschaft, Troisdorf, Fed. Rep. of Germany

[21] Appl. No.: 399,949

[22] Filed: Aug. 29, 1989

[30] Foreign Application Priority Data

Sep. 1, 1988 [DE] Fed. Rep. of Germany ..... 3829657

[51] Int. Cl.[4] ..... F42C 19/08

[52] U.S. Cl. ..... 102/202

[58] Field of Search ..... 102/202, 204, 372, 373, 102/469, 470

[56] References Cited

U.S. PATENT DOCUMENTS 4,492,167 1/1985 Brede et al. ..... 102/204

4,674,405 6/1987 Brede et al. ..... 102/202

*Primary Examiner*—Charles T. Jordan

*Attorney, Agent, or Firm*—Antonelli, Terry & Wands

[57] ABSTRACT

Ignition of a separating charge in a cavity between a flash-conducting tube and a casing of a propellant charge igniter extending below a combustible tube is brought about by the propellant gases passing through priming bores from the outside of the propellant charge igniter to be used in a breech of a cannon or like weapon. This requires a seal acting in the manner of a valve being positioned at the flash-conducting tube head and being urged towards the casing. An especially suitable sealing means in a sealing ring located in an annular groove having a cross-section shape similar to a trapezoid. In case, for example, on account of low temperatures, the pressure buildup of the propellant gases occurs more gradually, the separation of the combustible tube from the bottom piece is thereby also automatically initiated at a later point in time. Thereby, flashback in the breech zone of the cannon is avoided and ballistics are improved.

15 Claims, 2 Drawing Sheets

PROPELLANT CHARGE IGNITER WITH A SEPARATING CHARGE, WHICH IS INITIATED BY A PROPELLANT CHARGE POWDER

BACKGROUND OF THE INVENTION

This invention relates to a propellant charge igniter for use in a breech of a weapon, the igniter containing a bottom piece and a head section of an initiator piece with an initiator charge, a flash-conducting tube head leading to a propagation or booster charge surrounded by a combustible tube with blowout bores, as well as a cavity containing a separating charge between the flash-conducting tube and a metallic casing extending below the combustible tube; the cavity extending somewhat past the top edge of the metallic casing and of the bottom piece, so that separation of the combustible tube takes place by gases of the separating charge passing directly above the top edge of the bottom piece.

A partially combustible propellant charge igniter has been known from DE No. 3,502,166 C2. The separating charge is to serve for completely severing a combustible tube encompassing the propagation or booster charge from the bottom piece. The separating charge is initiated by way of one or several bores in the head of the flash-conducting tube by back-flowing combustion gases of the pill column of the propagation charge. Valve disks are disposed in the flash-conducting tube head; these disks flip over upon a pressure rise due to deflagration of the separating charge. With progressive combustion of the separating charge, the pressure increases to such an extent that there finally occurs the desired separation of the combustible tube directly above the top edge of the bottom piece.

Burning of the propagation or booster charge takes place in dependence on the temperature. As a result, it may happen, especially at temperatures of below 0° C., that ignition of the separating charge by back-flowing gas of the propagation charge occurs too early. When firing live ammunition, this can result in disturbances of the ballistics; also, flashbacks can occur in the breech region of the cannon.

SUMMARY OF THE INVENTION

It is an object of the invention to provide a precise ignition of the separating charge adapted to the ambient temperature.

This object has been attained by a propellant charge igniter characterized by one or several priming bores establishing a connection between a cavity containing the separating charge and the outside of the propellant charge igniter, and by a seal acting like a valve at the head of the flash-conducting tube and cooperating with a metallic casing, this seal, on the one hand, preventing direct entrance of gases of the propagation charge into the cavity, but permitting exiting of the gases of the separating charge through the combustible tube above the top edge of the bottom piece. Other advantageous embodiments are described hereinafter.

According to the invention, the separating charge thus is no longer directly ignited by the returning gases of the pill column of the propagation or booster charge because the velocity of propellant gas evolution is dependent on the temperature. Only once a specific propellant gas pressure has been built up, i.e. when deflagration proceeds, then only in accordance with the specific properties of the propellant charge powder, independently of the ambient temperature, will ignition of the separating charge take place from the outside through the casing via the priming bores. While heretofore the separating charge was ignited as early as 2–4 milliseconds after initiation of the primary igniter element, and the onset of pressure buildup by the propellant charge gases began considerably later in dependent on the ambient temperature, a premature ignition of the separating charge is now impossible. Such ignition is in fixed chronological relation to the pressure rise and, respectively, the maximum of the pressure of the propellant gases.

The sealing means at the flash-conducting tube head in the arrangement of the present invention has, in a certain way, the opposite function from that of the partially combustible propellant charge initiator known from DE No. 3,502,166 C2. Therefore, special importance is to be attributed also to the design of the seal at the flash-conducting tube. In a preferred embodiment, a groove is provided, which as seen in cross section, has a shape generally like that of a trapezoid with the parallel sides in parallel to the metallic casing. An O-seal is in contact with the relief surface of the sides of the trapezoid facing the bottom piece; i.e. the side of the groove within the bottom piece. It is important that the metallic casing support the O-seal in this "sealing position" from the outside. Penetration of vapors from the propagation charge into the cavity with the separating charge is precluded in this way. At the time the separating charge is ignited, the deflagration velocity of this charge being higher by a multiple than in case of the propellant charge powder, the seal at the flash-conducting tube head is to be eliminated. The O-seal is pushed upwards in the groove by the gases of the separating charge to such a level that the gases can sever the combustible tube, which tube is weakened already anyway, without leaving any residues above the bottom piece. For this reason, it is advantageous if the side of the trapezoid facing the propagation charge is beveled or rounded, i.e. the side of the groove extending from near the top edge of the bottom piece to above the bottom piece. In this way, there will always be obtained a perfectly unobstructed gun barrel after firing.

BRIEF DESCRIPTION OF THE DRAWINGS

The invention is illustrated in the accompanying drawings and furthermore described in greater detail with reference to the drawings wherein.

Figure 1:
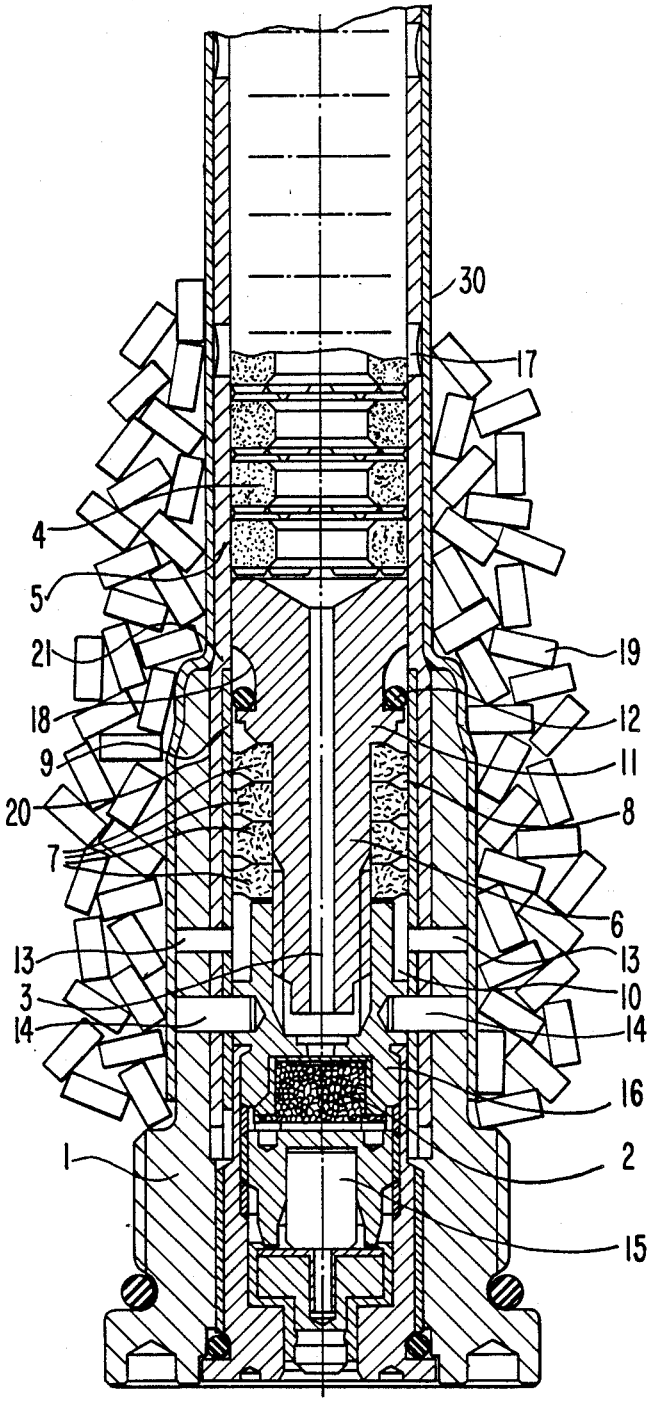
FIG. 1 shows a partial sectional view through the bottom part of a propellant charge igniter.

An electrically initiatable primary igniter element 15 is installed in the bottom piece or housing 1 of a propellant charge igniter. This primary igniter element ignites an initiator charge 2. The thus-forming ignition flash is conducted through a duct or passage 3 in a flash-conducting tube 6 into the propagation or booster charge 4 made up of a plurality of pills or pellets. The propagation or booster charge 4 is held together by a combustible tube 5. The combustible tube 5 is partially drawn into the bottom piece 1 and supported from the inside in the lower zone of the assembly by a metallic casing 9, made for example, of Cu Zn 37 F 37. An upper sleeve or housing 30 surrounds an upper portion of the bottom piece and extend upwardly to support the combustible tube 5. Blow-out bores 17 are provided in the combustible tube 5.

A cavity 8 is provided between the flash-conducting tube 6 and the combustible tube 5 and, respectively, the casing 9; this cavity is extensively filled with annular propellant charge pills of a separating charge 7. This cavity 8 is sealed with respect to the propagation charge 4, as illustrated in greater detail in FIG. 2. For improving the strength of the assembly, the bottom piece 1, the casing 9, and a head section 16 of the initiator piece are joined by means of clamping pins 14.

Primary bores 13 extending through the casing 9, the combustible tube 5, the bottom piece 1 and the housing 30, constitute a characteristic feature of the present invention; through these bores, the separating charge 7 is ignited from the outside by the propellant charge powder 19 surrounding the propellant charge initiator. The cavity 8 is in this arrangement connected, on the side facing the bottom piece 1, via a further cavity 10 with the primary bores 13 which in this case are four in number and are uniformly distributed around the periphery.

According to the invention, ignition of the separating charge 7 is always coupled chronologically with a specific propellant gas pressure, and separation of the combustible tube takes place with great precision.

Figure 2:
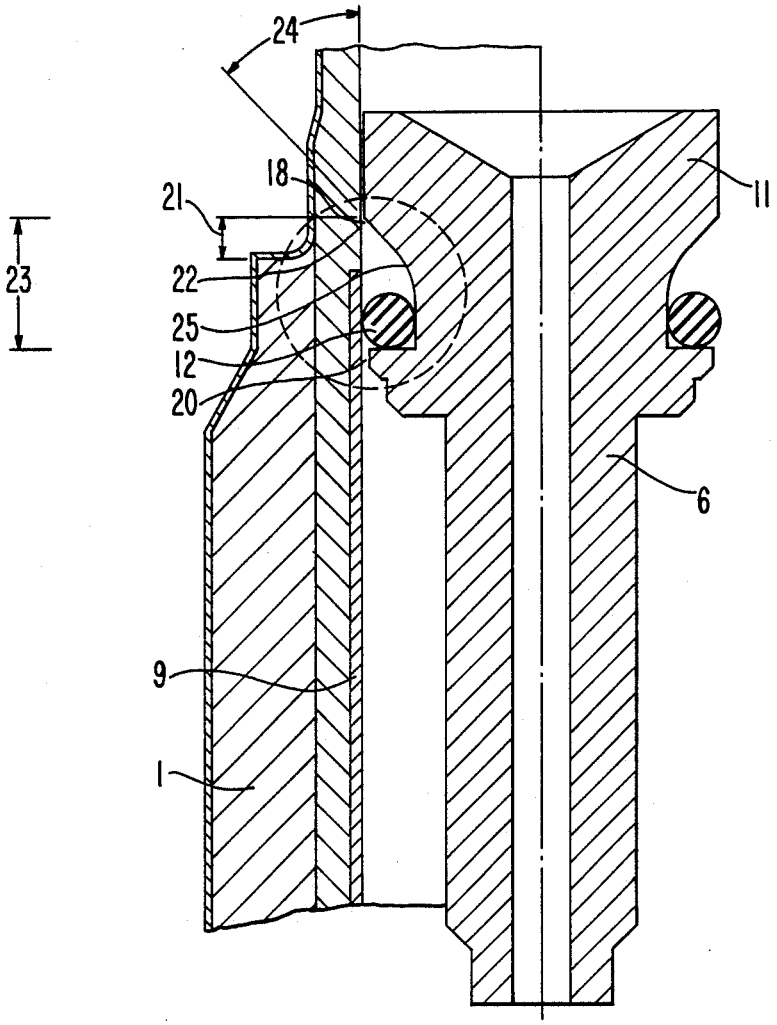
FIG. 2 is a longitudinal section through a flash-conducting tube with a specially configured seal.

For the separation of the combustible tube 5 without leaving any residues, the combustible tube having no sealing ring 12 as shown, should be present so that the vapors of the separating charge can pass, guided by the metallic sleeve 9 and the flash-conducting tube 6, via a gap 20 between the flash-conducting tube 11 and the casing 9 to the zone 21 of the combustible tube 5 on the top edge of the bottom piece 1, which is the desired separating region However, such a construction would allow penetration of gases generated by the propagation charge and could cause premature separation. A preferred embodiment of the flash-conducting tube 6 is provided with a special seal in the flash-conducting tube head 11 as shown in FIG. 2; the positions of the top edges of the metallic casing 9 and the bottom piece 1 being included in the illustration on the left-hand side. An annular groove 18 in this arrangement has a trapezoidal cross section in approximation, the transition of the wall surfaces in the upward direction toward the propagation charge extending circular and then conically. In the downward direction toward the bottom piece 1, the groove 18 has a wall surface that substantially abuts the casing 9 perpendicularly. An O-seal 12 made of polymeric material is to be deformed, in the installed condition by about 3–20%. The metallic casing 9 is to extend for such a distance that it is capable of supporting the sealing ring 12 toward the outside The gap 20 between the metallic casing 9 and the flash-conducting tube head 11 is 0.75 mm. The region 21 between the top edge of the bottom piece 1 and the termination 22 of the groove 18 has a width of between 0.8 mm and 2.5 mm, preferably between 1.3 mm and 2.0 mm. The terminating angle 24 of the side of the trapezoid facing away from the bottom piece 1 amounts to 45° , and the radius of curvature of the rounded portion of the groove 25 is 3 mm.

What is claimed is:

1. A propellant charge igniter which comprises a bottom piece, an initiator piece head section surrounding an initiator charge located within the bottom piece, a flash-conducting tube following the initiator charge, with a flash-conducting tube head being positioned next to a propagation charge surrounded by a combustible tube with blowout bores, a cavity containing a separating charge located between the flash-conducting tube and a metallic casing extending below the combustible tube and located with the bottom piece, the cavity extending beyond a top edge of the metallic casing and a top edge of the bottom piece, separation of the combustible tube taking place by gases resulting from deflagration of the separating charge directly above the top edge of the bottom piece, at least one priming bore establishing a connection between the cavity containing the separating charge and a zone located outside of the propellant charge igniter, and a seal acting like a valve at the flash-conducting tube head toward the casing, said seal, on the one hand, preventing direct entrance of gases of the propagation charge into the cavity and, on the other hand, permitting exiting of the gases of the separating charge through the combustible tube above the top edge of the bottom piece

2. A propellant charge igniter according to claim 1, wherein the top edge of the casing and the top edge of the bottom piece are congruent.

3. A propellant charge igniter according to claim 1, wherein the seal acting like a valve comprises an O-shaped seal of a polymeric material and a groove, the groove as seen in cross section, having in approximation the form of a trapezoid with parallel sides in parallel to the casing, a side of the trapezoid forming the relief surface for the O-seal, facing the bottom piece extending perpendicularly to the casing, a side of the trapezoid facing the propagation charge being beveled or rounded and projecting past the top edge of the bottom piece to such an extent that the O-seal is movable by the gases of the separating charge past the top edge of the casing toward the propagation charge so that the gases will contact and destroy the combustible tube.

4. A propellant charge igniter according to claim 2, wherein the seal acting like a valve comprises an O-shaped seal of a polymeric material and a groove, the groove as seen in cross section, having in approximation the form of a trapezoid with parallel sides in parallel to the casing, a side of the trapezoid forming the relief surface for the O-seal, facing the bottom piece extending perpendicularly to the casing, a side of the trapezoid facing the propagation charge being beveled or rounded and projecting past the top edge of the bottom piece to such an extent that the O-seal is movable by the gases of the separating charge past the top edge of the casing toward the propagation charge so that the gases will contact and destroy the combustible tube.

5. A propellant charge igniter according to claim 3, wherein the depth of the groove is from 1 to 4 mm.

6. A propellant charge igniter according to claim 3 wherein a region of the groove projecting past the metallic casing is 0.8 mm to 3.0 mm, preferably 1.3 to 2.0 mm in length.

7. A propellant charge igniter according to claim 3, wherein a radius of curvature of a rounded portion in the groove is 1 mm to 5 mm, and a terminating angle of the side of the trapezoid facing away from the bottom piece is 30° to 60°.

8. A propellant charge igniter according to claim 1, wherein a gap between the flash-conducting tube head and the metallic casing is provided, said gap being an annular opening between the groove and the cavity and being 0.5 mm to 1.5 mm in width.

9. A propellant charge igniter according to claim 1, wherein the diameter of the metallic casing is 12 mm to 20 mm.

10. A propellant charge igniter according to claim 1, wherein the at least one priming bore is arranged on the side of the cavity containing the separating charge which is close to the bottom piece.

11. A propellant charge igniter according to claim 10, wherein a further cavity is present between the at least one priming bore and the cavity that contains the separating charge.

12. A propellant charge igniter according to claim 1, wherein the diameter of a priming bore is 1 mm to 5 mm, preferably 1.5 mm to 2.5 mm.

13. A propellant charge igniter according to claim 1, wherein four priming bores are uniformly distributed along the periphery of a housing containing the bottom piece.

14. A propellant charge igniter according to claim 1, wherein the connection of the casing and the initiator piece head section with the bottom piece is reinforced by clamping pins.

15. A propellant charge igniter according to claim 3, wherein the O-shaped seal is a sealing ring consisting of a temperature-resistant synthetic resin.

* * * * *